US005211372A

United States Patent [19]

Smith, Jr.

[11] Patent Number: 5,211,372

[45] Date of Patent: May 18, 1993

[54] EXHAUST VALVE FOR A GAS EXPANSION SYSTEM

[75] Inventor: Joseph L. Smith, Jr., Concord, Mass.

[73] Assignee: Massachusetts Institute of Technology, Cambridge, Mass.

[21] Appl. No.: 728,544

[22] Filed: Jul. 11, 1991

[51] Int. Cl.[5] ..... F16K 31/44

[52] U.S. Cl. ..... 251/75; 251/129.19; 251/129.22; 251/284

[58] Field of Search ..... 251/75, 129.22, 205, 251/356, 122, 129.19, 284; 137/599, 625.3

[56] References Cited

U.S. PATENT DOCUMENTS

| | | | |
|---|---|---|---|
| 2,625,437 | 1/1953 | Huntington | 251/75 |
| 2,681,177 | 6/1954 | Hartwell | 251/129.2 |
| 3,417,768 | 12/1968 | Wasson | 251/75 |
| 3,921,670 | 11/1975 | Clippard, Jr. et al. | 137/625.6 X |
| 4,203,554 | 5/1980 | Zimmer et al. | 251/129.09 |
| 4,911,405 | 3/1990 | Weissgerber | 251/129.19 |

*Primary Examiner*—A. Michael Chambers
*Attorney, Agent, or Firm*—Robert F. O'Connell

[57] ABSTRACT

A exhaust valve for use in a cryogenic gas expansion system which uses a non-metallic valve seat and a metallic valve disk assembly which is moved into and out of contact with the valve seat to close and open the valve, respectively. The valve disk assembly has a valve disk element, a number of spring elements, and a ring element, all of which are integrally formed from a single metallic sheet. The valve disk element moves with a non-linear, snap action movement which movement is controlled by a cryogenic solenoid. When the disk element is moved out of seated contact with the valve seat and reaches a position just past the point at which the snap action has commenced, the movement is limited by a stop element so that the force, and hence the solenoid current, required to hold the valve open at that position is minimized.

9 Claims, 1 Drawing Sheet

EXHAUST VALVE FOR A GAS EXPANSION SYSTEM

INTRODUCTION

This invention relates generally to valves for use in gas expansion systems and, more particularly, to a unique exhaust valve capable of operating effectively at very low expander exhaust temperatures, which valve is particularly effective for use in cryogenic gas expansion systems.

BACKGROUND OF THE INVENTION

Gas expansion systems have long been known and have found use for many years in cryogenic applications to achieve very low temperatures in spatial regions at or near the expansion volumes thereof. A particularly effective system for such purpose has been described, for example, in U.S. Pat. No. 4,862,694 issued to Crunkleton et al.

Exhaust valves in such cryogenic systems must operate at very low temperatures, e.g., at temperatures in a range from about 5° K. to about 3° K. At such cryogenic temperatures conventional valve structures often tend to provide unsatisfactory and unreliable operation over time. In addition, conventional cryogenic valve structures require complex mechanical operating means that provide heat leak paths to the low temperature region. For example, at such low temperatures, valves requiring metal-to-metal contact between valve elements tend to produce relatively rapid wear and galling of the metal parts thereof. It is desirable to provide an improved exhaust valve structure which operates more reliably at the low temperatures generated at the expansion volumes of a gas expansion system and which is compatible with a low loss cryogenic solenoid operator.

BRIEF SUMMARY OF THE INVENTION

In accordance with the invention, an exhaust valve utilizes a movable valve member comprising a metallic valve disk element and a non-linear metallic spring element, which elements are integrally formed to provide a movable valve member. The movable valve member is actuated for movement by a double-acting cryogenic solenoid which causes the valve disk element to seat and unseat on a non-metallic surface of a fixedly mounted valve seat element so as to close and open the valve, respectively. The non-linear nature of the spring reduces the "hold-open" force required to maintain the valve in its open state and, accordingly, reduces the heat which tends to be generated by a hold-open current used in the cryogenic solenoid actuator. Further, the valve assembly is located relative to the expansion volume at which it is used so as to permit ready access and servicing of the valve without the need to open the vacuum normally required in a system for gas expansion operation.

DESCRIPTION OF THE INVENTION

Figure 1:
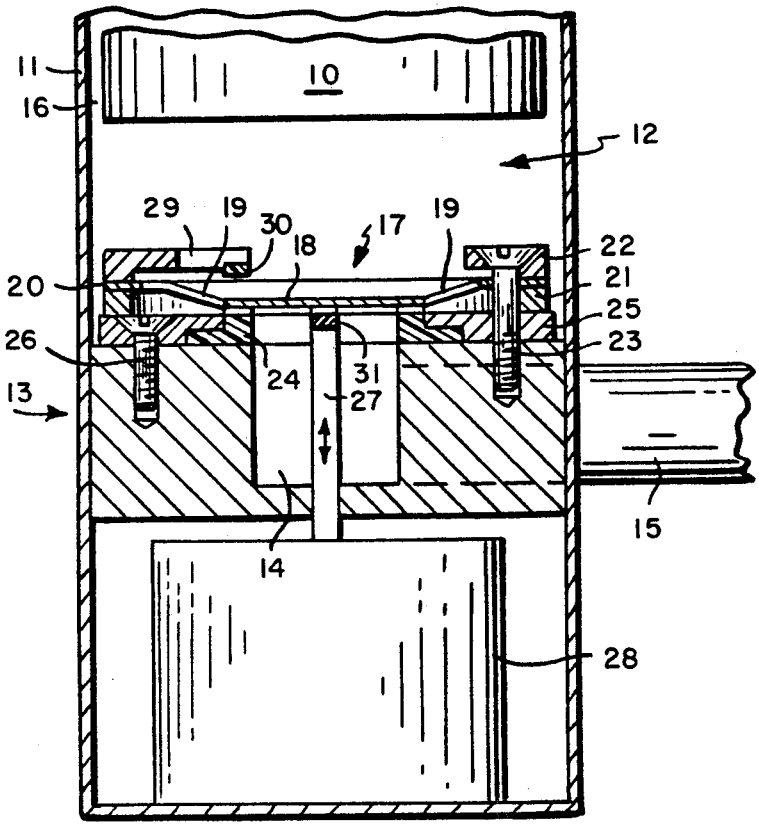
Figure 2:
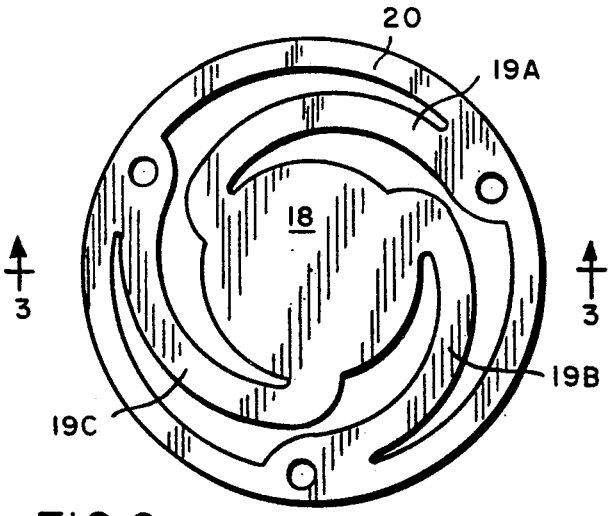
Figure 3:
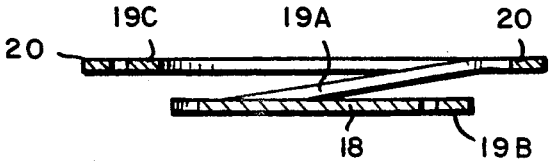

The invention can be described in more detail with the help of the accompanying drawing wherein FIG. 1 shows a view in section of a portion of a gas expansion system depicting a particular embodiment of an exhaust valve assembly of the invention used at the expansion volume "cold" end of the system;

FIG. 2 shows a plan view of the valve disk element of the exhaust valve assembly depicted in FIG. 1; and FIG. 3 shows a view in section along line 3—3 of the valve disk element depicted in FIG. 2.

An exhaust valve in accordance with the invention can be used effectively at the expansion volume of a gas expansion system, particularly a system designed for producing extremely low temperatures at the expansion volume, such as in cryogenic liquid helium applications. A system for such use is described, for example, in the aforementioned Crunkleton et al. patent. An exemplary portion of such a system is shown in FIG. 1 which depicts the gas expansion volume end thereof, i.e., the "cold" end of the system. As seen therein, an expander, or drive, piston 10 is movable within a cylindrical housing 11 above an expansion volume 12.

The lower end of expansion volume 12 is closed with a cylinder head assembly 13 which includes a gas exhaust port 14 connected to a gas exhaust output line 15. An exhaust valve 17 comprises a valve disk element 18 integrally formed with spring elements 19 and an outer ring portion 20. The valve disk element 18 and spring elements 19 are positioned within cylinder head assembly 13 so that ring 20 rests on a spacer element 21 and is clamped between spacer element 21 and a clamp ring 22 which is held in place by one or more screws 23 (one of which is shown in FIG. 1). A valve seat 24 is clamped to cylinder head 13 by a clamp ring 25 which is held in place by one or more screws 26 (one of which is shown in FIG. 1). In the closed valve position shown in FIG. 1, valve disk 18 is positioned above the upper end of a vertically movable, operating plunger 27 of a double-acting cryogenic solenoid 28.

During operation, expansion volume 12 is filled with a working gas, e.g., helium, at high pressure via an appropriately opened intake valve (not shown), which valve is normally located at the upper "warm" end of the system, as the piston 10 is moved from its lowermost or compressed position. The high pressure gas is supplied, for example, via the intake valve and thence through the gap or channel 16 between the inner wall of cylinder 11 and the outer wall of piston 10 and is retained at high pressure in the expansion volume, as would be well understood from the description provided in the aforesaid Crunkleton et al. patent.

When a suitable quantity of high pressure gas has entered expansion volume 12, the intake valve is closed. The piston 10 is caused to move upwardly so that the gas confined in expansion volume 12 and in gap 16 expands and the pressure thereof falls to a low level somewhat above the exhaust pressure in exhaust port 14 and exhaust output line 15.

When piston 10 reaches its maximum upward, or topmost, expanded position, exhaust valve 17 is opened, against the force imposed by the differential pressure which exists between the pressure in expansion volume 12 and the pressure in exhaust port 14 by the upward movement of plunger 27 under control of solenoid 28 which is actuated for such purpose. Such actuation lifts off valve disk 18 from valve seat 24. As the valve disk 18 moves upwardly against such pressure, it moves to a selected open position where it is retained, further movement being limited by finger stops 29 mounted on clamp ring 22, as discussed in more detail below. After valve 17 is opened, the solenoid 28 continues to hold the valve open as piston 10 is moved downwardly. The piston motion thereby pushing most of the expanded gas in expansion volume 12 through the opened valve 17 into the exhaust port 14 and thence outwardly through exhaust line 15.

At an appropriately selected time thereafter, as the piston 10 continues to move downwardly, solenoid 28 is actuated to move to the plunger 27 downwardly, the forces of spring elements 19 causing the valve to snap back to a closed position at which the valve disk 18 is seated on valve seat 24 to close the valve. As the piston 10 continues to move downwardly to its lowest most position, residual gas remaining in expansion volume 12 and gap 16 is compressed to a pressure near that of the high pressure gas which is introduced into the expansion volume when the intake valve is opened. As the pressure in expansion volume rises, the pressure difference between the pressure in expansion volume 12 and the pressure in exhaust port 14 across valve disk 18 pushes the valve disk 18 securely against valve seat 24 to prevent any gas leakage through the valve.

As pointed out above, clamp ring 22 is provided with one or more finger stops 29, each having a non-metallic tip element 30. The finger stops limit the upward travel of the integrally formed valve disk element and spring elements when the valve disk element is moved upwardly to open the valve. A non-metallic tip element 31 at the upper end of plunger 27 contacts the lower surface of disk 18 so as to cause the disk to move upwardly to its open position. The disk element travels to a point just past the point at which it effectively begins a non-linear, snap action upwardly at which point it is stopped from further upward movement by finger stop 29.

The integrally formed valve disk and spring assembly is shown in more detail in FIGS. 2 and 3. As seen therein, in a particular preferred embodiment three spring elements 19A, 19B and 19C are formed therein. In the embodiment shown, the valve disk 18, springs 19A, 19B and 19C and outer ring 20 are preferably all cut from a single sheet of spring sheet of spring steel so as to form the assembly as an integral structure. The assembly is heat treated with the valve disk 18 positioned below the outer ring 22 (as in FIG. 3) so that the valve disk 18 will be forced against valve seat 24 when the valve is assembled and placed in the cylinder head assembly 13 and no upward contact force on the disk is present from plunger 27.

The radial compression characteristics of springs 19 will tend to cause a non-linear snap-through action as the disk 18 is moved from such position to an upward position generally in the plane of ring 20, the valve disk has just begun its snap action which would normally cause it to travel in a non-linear manner to a position above such plane. When it reaches a selected position generally in the plane of ring 20, the finger stop 29 prevents further upward motion. However, the non-linear snap action which has effectively commenced at that point minimizes the upward force at plunger 27 that is required to hold the valve open and, hence, minimizes the hold-open current needed in the solenoid for such purpose. When the solenoid moves the plunger 27 downwardly so as to remove such force, the action of the springs forces the disk to snap back to its seated position on valve seat 24.

Although an external vacuum is normally required to enclose the overall piston/cylinder assembly as used in such a ga expansion system, no vacuum is required for the piston assembly in the interior of the cylinder 11. Thus, the valve of the invention is located so that it can be readily accessed for servicing once the piston assembly is removed from the cylinder 11 without the need to open or otherwise disturb the external vacuum in which the piston/cylinder assembly is enclosed.

Valve seat 24, and tip elements 30 and 31, can be made of a suitable plastic material, e.g., a polytetrafluoroethyl polymer (PTFE) material, such as Teflon® or Kel-F®. Thus, the metallic snap-action valve disk element 18 only contacts non-metallic elements during its operation so that wear and galling thereof, which would normally occur at cryogenic temperatures from metal-to-metal contact, are avoided.

While the embodiment of the invention discussed above represents a preferred embodiment thereof, modifications thereto may occur to those in the art within the spirit and scope of the invention. Hence, the invention is not to be construed as limited to the specific embodiment described, except as defined by the appended claims.

What is claimed is:

1. A valve for use in a gas expansion system, said valve comprising a valve seat;

an integrally formed valve disk assembly comprising a metallic valve disk element and a plurality of metallic spring elements, said valve disk assembly being mounted adjacent said valve seat for movement of said valve disk element into and out of a seated position on said valve seat, whereby said valve is placed in a closed state or in an opened state, respectively;

means for moving said valve disk element out of said seated position to place said valve in its opened state, said spring elements causing said disk element to move in a non-linear manner during its movement out of said seated position; and means for limiting the movement of said valve disk element to a selected position which minimizes the force required for holding said valve in its opened state.

2. A valve in accordance with claim 1 wherein said valve disk assembly has a circular shape, the valve disk element being centrally located in said assembly, the spring elements being positioned at selected locations around said centrally located disk element in said assembly, and a ring element being formed in said assembly around said spring elements.

3. A valve in accordance with claim 2 wherein said disk element, said spring elements, and said ring element are all formed from a single metallic sheet.

4. A valve in accordance with claim 3 wherein said metallic sheet is made of spring steel.

5. A valve in accordance with claim 1 wherein said moving means includes a movable plunger element and a solenoid, the movement of said plunger element being controlled by said solenoid, said plunger element being moved to contact said valve disk element so as to move it out of its seated position when said valve is to be placed in its opened state, the minimization of said force minimizing the current required in said solenoid to hold said valve in its opened state.

6. A valve in accordance with claim 5 wherein said plunger is moved out of contact with said valve disk element when said valve is to be moved from its opened state to its closed state, the spring elements thereby causing said valve disk element to move in a non-linearly manner so as to return to its seated position on said valve seat.

7. A valve in accordance with claim 5 wherein said plunger element has a non-metallic tip for contacting said valve disk element.

8. A valve in accordance with claim 1 wherein said limiting means includes at least one finger stop member having a non-metallic tip, said tip contacting said valve disk element when it reaches said selected position.

9. A valve in accordance with claim 1 wherein said valve seat is non-metallic.

* * * * *